US012296250B2

(12) United States Patent
Higginbotham

(10) Patent No.: US 12,296,250 B2
(45) Date of Patent: May 13, 2025

(54) INLINE WHEELED TRUCK

(71) Applicant: Thomas W. Higginbotham, Gardendale, AL (US)

(72) Inventor: Thomas W. Higginbotham, Gardendale, AL (US)

( * ) Notice: Subject to any disclaimer, the term of this patent is extended or adjusted under 35 U.S.C. 154(b) by 0 days.

(21) Appl. No.: 18/669,512

(22) Filed: May 20, 2024

(65) Prior Publication Data

US 2024/0382821 A1 Nov. 21, 2024

Related U.S. Application Data

(60) Provisional application No. 63/582,754, filed on Sep. 14, 2023, provisional application No. 63/503,090, filed on May 18, 2023.

(51) Int. Cl.
*A63C 17/00* (2006.01)
*A63C 17/22* (2006.01)

(52) U.S. Cl.
CPC ..... *A63C 17/0093* (2013.01); *A63C 17/226* (2013.01)

(58) Field of Classification Search
CPC .... A63C 17/0093; A63C 17/06; A63C 17/061
See application file for complete search history.

(56) References Cited

U.S. PATENT DOCUMENTS

| | | | | |
|---|---|---|---|---|
| 893,341 | A * | 7/1908 | Martinsen | A63C 17/06 280/11.233 |
| 3,086,787 | A * | 4/1963 | Wyche | A63C 17/0086 280/11.26 |
| 4,666,168 | A * | 5/1987 | Hamill | A63C 17/0086 280/11.209 |
| 6,186,518 | B1 * | 2/2001 | Moses | A63C 17/0046 280/11.225 |
| 8,308,171 | B2 * | 11/2012 | Farrelly | A63C 17/06 280/11.233 |
| 2009/0045596 | A1 * | 2/2009 | Boucher | A63C 17/062 280/11.223 |
| 2009/0174163 | A1 * | 7/2009 | Farrelly | A63C 17/06 280/87.041 |
| 2012/0038121 | A1 * | 2/2012 | Chen | A63C 17/0033 280/11.223 |
| 2021/0245033 | A1 * | 8/2021 | Gorden | A63C 17/06 |

* cited by examiner

*Primary Examiner* — Brian L Swenson

(57) ABSTRACT

An inline wheeled truck is a structural arrangement for wheels on a skating device. The inline wheeled truck includes a first wheel, a second wheel, a left elongated bracket, a right elongated bracket, a cross platform, a base platform, a first support member, and a second support member. The first wheel and the second wheel allows the inline wheeled truck to roll in a forward direction and a backward direction. The left elongated bracket and the right elongated bracket evenly space and structurally secure the first wheel and the second wheel. The cross platform structurally bridges the left elongated bracket and the right elongated bracket. The first support member and the second support member are connected in between the cross platform and the base platform and convert a tilting motion of the base platform into a steering motion of the cross platform.

18 Claims, 7 Drawing Sheets

INLINE WHEELED TRUCK

The current application claims a priority to the U.S. provisional patent application Ser. No. 63/503,090 filed on May 18, 2023. The current application is filed on May 20, 2024, while May 18, 2024 was on a weekend.

The current application claims a priority to the U.S. provisional patent application Ser. No. 63/582,754 filed on Sep. 14, 2023.

FIELD OF THE INVENTION

The present invention generally relates to wheel mechanisms. More specifically, the present invention is a set of two wide inline wheels connected to a truck assembly.

BACKGROUND OF THE INVENTION

A rigid in-line wheel system does not allow for sharper, cleaner turns. Thus, an objective of the present invention is to address this issue by providing a user with an in-line truck assembly that allows the in-line wheels to turn left or right sharply and cleanly by applying pressure to the left or right side of the assembly.

DETAILED DESCRIPTION OF THE INVENTION

Figure 1:
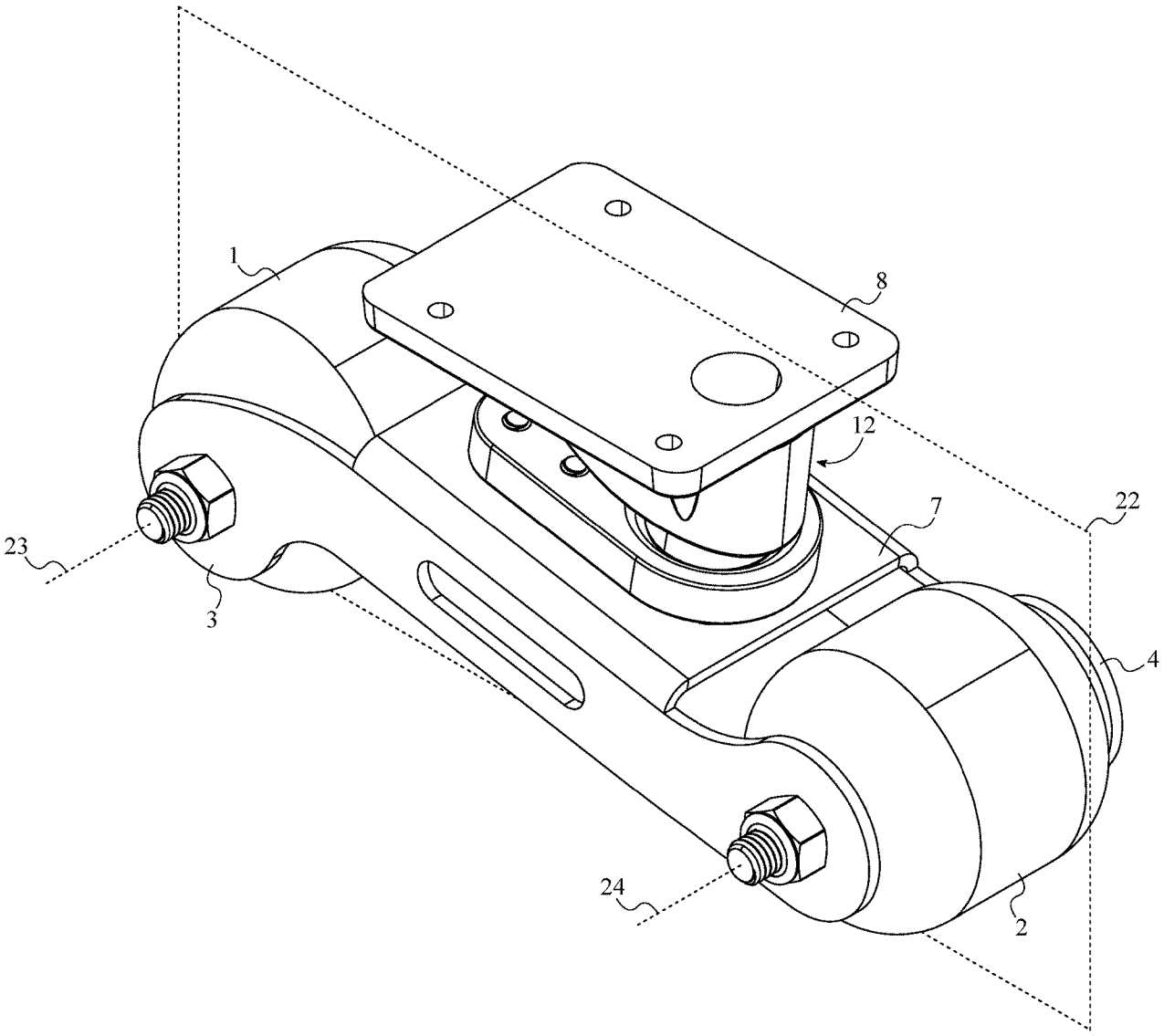
FIG. 1 is a top-left-rear perspective view of the present invention.
Figure 2:
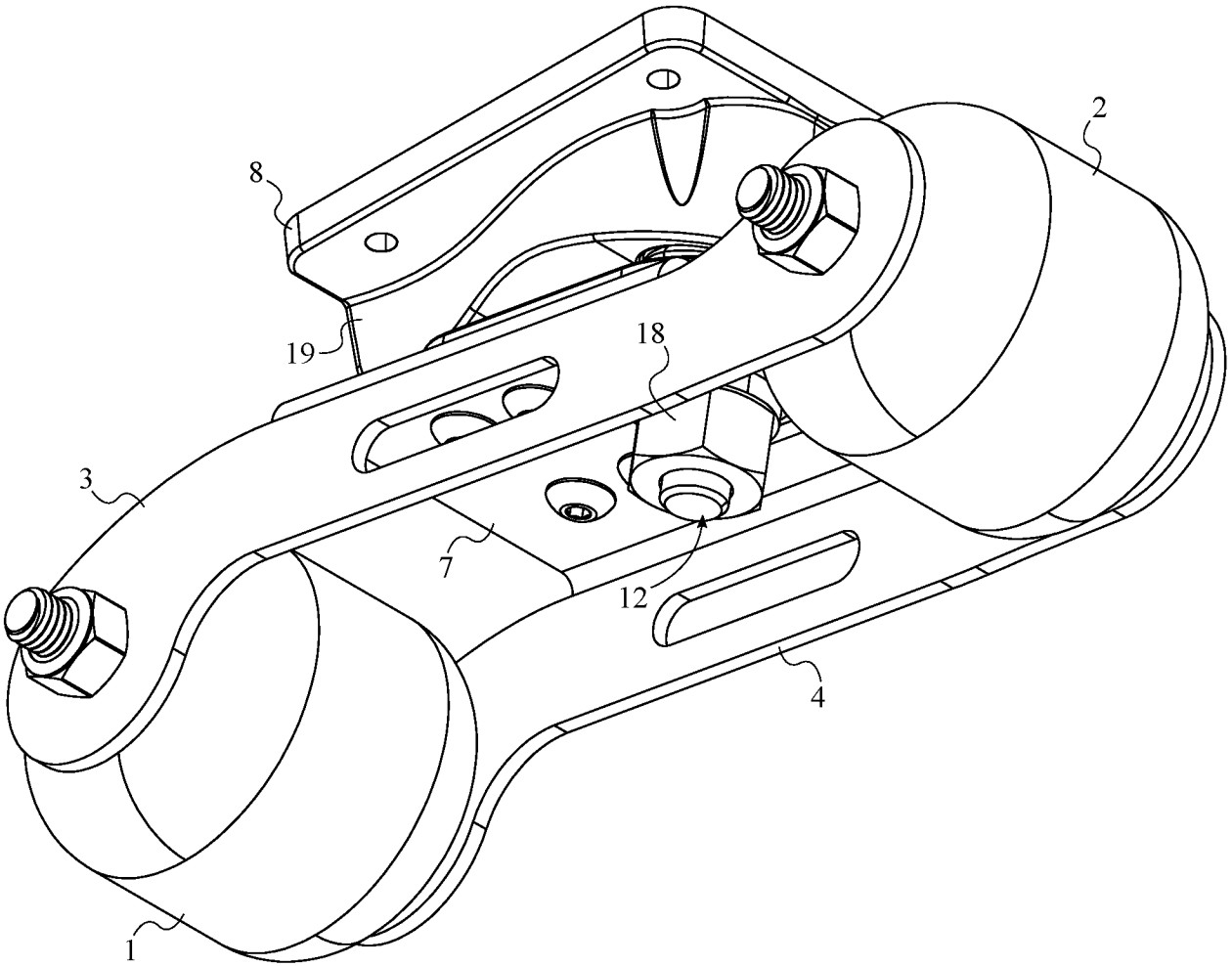
FIG. 2 is a bottom-left-rear perspective view of the present invention.
Figure 3:
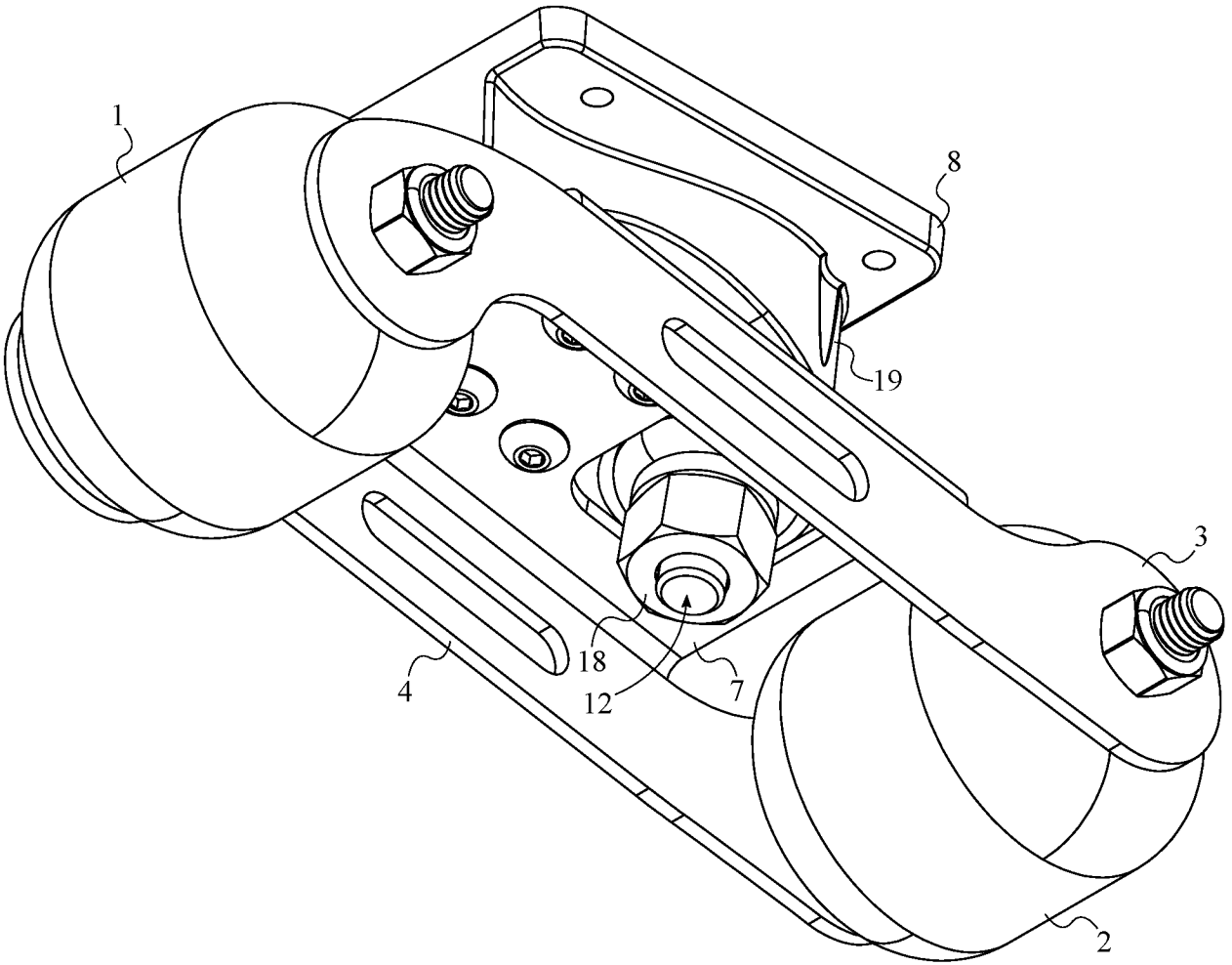
FIG. 3 is a bottom-left-front perspective view of the present invention.

All illustrations of the drawings are for the purpose of describing selected versions of the present invention and are not intended to limit the scope of the present invention.

The present invention is an inline wheeled truck, which is an improved structure and configuration for wheels on a skating device (i.e., a rollerblade, a skateboard, a longboard, a wheeled board configured to mimic the movements of a snowboard, etc.). When a tilting pressure in either the left or right direction is applied to the present invention, the angle of the tilting pressure determines how sharp the present invention turns in either left or right direction. When the present invention is straightened to its original angle before the tilting pressure, the components of the present invention return to their neutral positions. As can be seen in FIGS. 1 through 7, the present invention comprises a first wheel 1, a second wheel 2, a left elongated bracket 3, a right elongated bracket 4, a cross platform 7, a base platform 8, a first support member 9, and a second support member 12. The first wheel 1 and the second wheel 2 are used to evenly support the weight carried by the present invention and allow the present invention to roll forward or backward. The left elongated bracket 3 and the right elongated bracket 4 are two elongated bodies that extend between the first wheel 1 and the second wheel 2 in order to hold the first wheel 1 and the second wheel 2 in place on the present invention. The cross platform 7 is used as a nexus to hold the first wheel 1, the second wheel 2, the left elongated bracket 3, and the right elongated bracket 4 in place on the present invention and is used as a nexus to connect the base platform 8, the first support member 9, and the second support member 12 to the first wheel 1 and the second wheel 2. The first support member 9 and the second support member 12 are used as a bridge between the base platform 8 and the cross platform 7 and are to steer the present invention by tilting the base platform 8 in relation to the cross platform 7. The base platform 8 allows the present invention to be mounted to a foot-bracing board, a foot-restraining skate, or another device that is enabled to be rollable by the present invention.

As can be seen in FIGS. 1 through 7, the general configuration of the aforementioned components allows the present invention to be an inline wheeled device that can be steered by applying tilting pressure to the inline wheeled device. The left elongated bracket 3 and the right elongated bracket 4 each comprise a first bracket end 5 and a second bracket end 6, which are opposing ends of the respective elongated bracket. The left elongated bracket 3 and the right elongated bracket 4 are positioned parallel and offset from each other, which provides the necessary spacing and arrangement between the left elongated bracket 3 and the right elongated bracket 4 in order to hold the first wheel 1 and the second wheel 2 in place on the present invention. Thus, the first wheel 1 is rotatably mounted in between the first bracket end 5 of the left elongated bracket 3 and the first bracket end 5 of the right elongated bracket 4, and the second wheel 2 is rotatably mounted in between the second bracket end 6 of the left elongated bracket 3 and the second bracket end 6 of the right elongated bracket 4. This arrangement between the first wheel 1, the second wheel 2, the left elongated bracket 3, and the right elongated bracket 4 allows the weight carried by the present invention to be evenly distributed between the first wheel 1 and the second wheel 2. The cross platform 7 is connected in between the left elongated bracket 3 and the right elongated bracket 4 in order to structurally bridge the left elongated bracket 3 and the right elongated bracket 4 and to form one node for the tilt steering feature of the present invention. The base platform 8 is positioned offset from the cross platform 7, which allows the base platform 8 to form the other node for the tilt steering feature of the present invention. The first support member 9 and the second support member 12 are operatively mounted in between the cross platform 7 and the base platform 8 so that the first support member 9 and the second support member 12 can be flexed to steer the first wheel 1 and the second wheel 2.

As can be seen in FIGS. 1 through 7, the tilt steering feature of the present invention uses a specific configuration for the first support member 9. Thus, the present invention may further a cup bushing 15, and the first support member 9 may comprise a first proximal member end 10 and a first distal member end 11, which are opposing ends of the first support member 9. The cup bushing 15 is used to reduce friction at a pivot point between two members and is preferably a flexible resin bushing. Consequently, the first distal member end 11 is pivotably mounted to the base platform 8 by the cup bushing 15, which forms a pivot point between the first support member 9 and the base platform 8. Moreover, the first proximal member end 10 is stationarily mounted to the cross platform 7, which forms a fixed point between the first support member 9 and the cross platform 7.

As can be seen in FIGS. 1 through 7, the tilt steering feature of the present invention also uses a specific configuration for the second support member 12. Thus, the present invention may further comprise a proximal annular bushing 16, a distal annular bushing 17, and a lock nut 18, and the second support member 12 may comprise a second proximal member end 13 and a second distal member end 13, which are opposing ends of the second support member 12. In addition, the second support member 12 is preferably a kingpin, and the proximal annular bushing 16 and the distal annular bushing 17 are used to reduce friction at a lateral engagement between the kingpin and the cross platform 7. The proximal annular bushing 16 and the distal annular bushing 17 are preferably a pair of flexible resin bushings. The second distal member end 13 is stationarily mounted to the base platform 8, which creates a fixed point between the second support member 12 and the base platform 8. The second support member 12 is serially positioned through the distal annular bushing 17, through the cross platform 7, and through the proximal annular bushing 16, which creates a pivot point between the second support member 12 and the cross platform 7. The lock nut 18 is a fastener that holds the distal annular bushing 17, the cross platform 7, and the proximal annular bushing 16 in place along the second support member 12. Consequently, the second proximal member end 13 is threadibly engaged by the lock nut 18, which prevents any components held along the second support member 12 from sliding off of the second proximal member end 13. The distal annular bushing 17 is pressed against the cross platform 7, which reduces friction between the second support member 12 and one side of the cross platform 7. The proximal annular bushing 16 is pressed against the cross platform 7 by the lock nut 18, which reduces friction between the second support member 12 and the other side of the cross platform 7.

As can be seen in FIGS. 1 through 7, the present invention may further comprise a base extrusion 19, which is used to hold the distal annular bushing 17 in place against the cross platform 7. Thus, the base extrusion 19 is connected onto the base platform 8 and is a block of material extending from the base platform 8 towards the cross platform 7. The second support member 12 is positioned through the base extrusion 19 before the second support member 12 extends through the distal annular bushing 17, through the cross platform 7, and through the proximal annular bushing 16. The distal annular bushing 17 is pressed against the cross platform 7 by the base extrusion 19, which holds the distal annular bushing 17 in place against the cross platform 7 as the cross platform 7 is tilted in relation to the second support member 12. Moreover, the present invention may further comprise a distal washer 20 that has a same or similar diameter to the distal annular bushing 17. The second support member 12 is positioned through the distal washer 20 after the second support member 12 extends through base extrusion 19 and before the second support member 12 extends through the distal annular bushing 17, through the cross platform 7, and through the proximal annular bushing 16. Thus, the distal washer 20 is positioned in between the base extrusion 19 and the distal annular bushing 17, which allows the distal washer 20 to evenly distribute the load pressed against the distal annular bushing 17 by the base extrusion 19.

As can be seen in FIGS. 1 through 7, the present invention may further comprise a proximal washer 21 that has a same or similar diameter to the proximal annular bushing 16. The second support member 12 is positioned through the proximal washer 21 after the second support member 12 extends through the distal annular bushing 17, through the cross platform 7, and through the proximal annular bushing 16. Thus, the proximal washer 21 is positioned in between the proximal annular bushing 16 and the lock nut 18, which allows the proximal washer 21 to evenly distribute the load pressed against the proximal annular bushing 16 by the lock nut 18.

Figure 7:
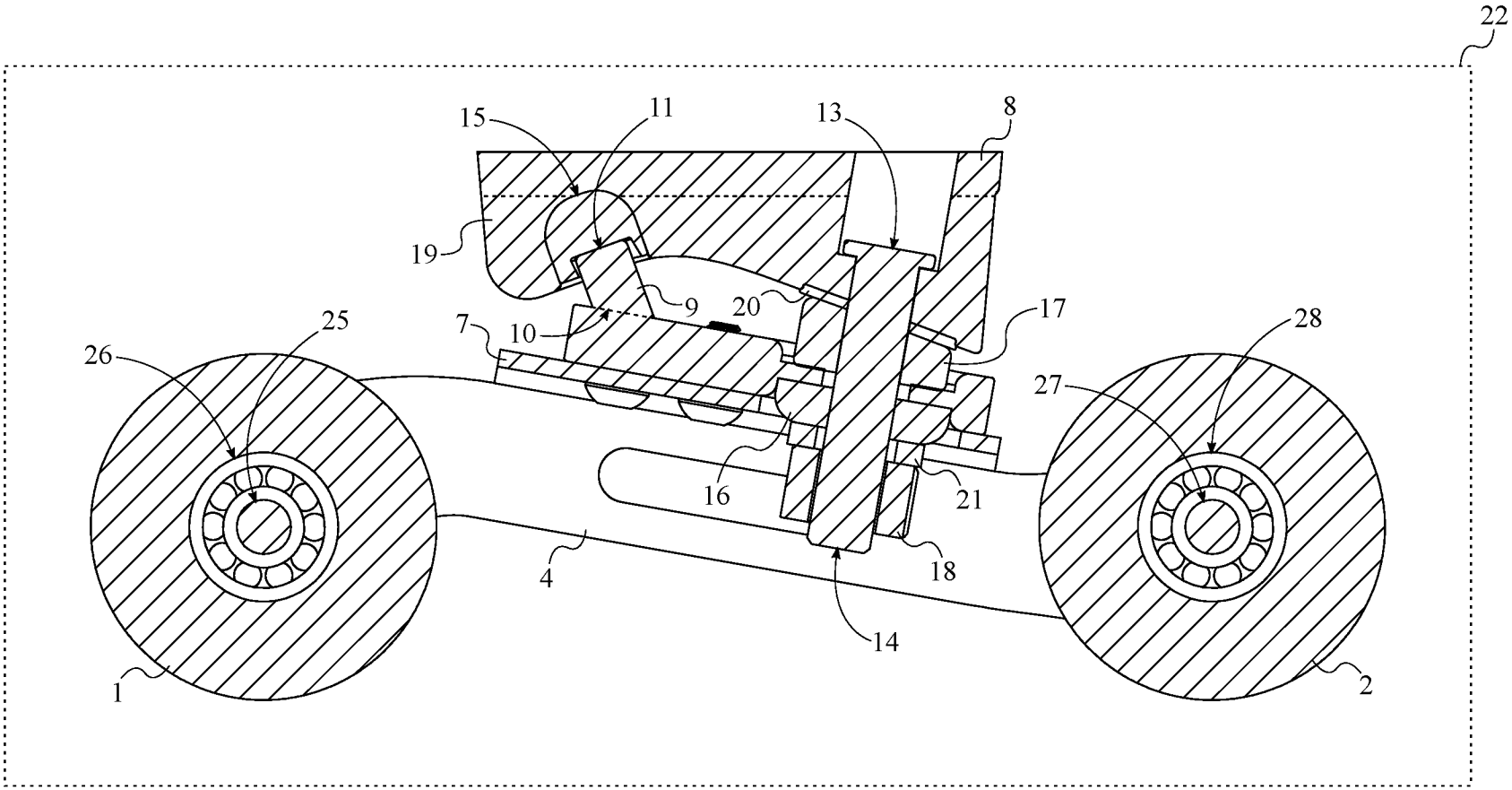
FIG. 7 is a cross-sectional view taken along line 7-7 in FIG. 6.

As can be seen in FIGS. 1 and 7, the general configuration of the aforementioned components can be further defined by a sagittal plane 22 of the present invention, which is a plane that defines the bilateral symmetry of an object. The first support member 9 and the second support member 12 are positioned coincident to the sagittal plane 22, which prevents the uneven distribution of the weight carried by the present invention. Moreover, a first rotation axis 23 of the first wheel 1 and a second rotation axis 24 of the second wheel 2 are positioned normal to the sagittal plane 22, which allows the present invention to roll the weight carried by the present invention in a direction that is perpendicular to the direction of gravity. The left elongated bracket 3 and the right elongated bracket 4 are positioned parallel to the sagittal plane 22 so that the first wheel 1 and the second wheel 2 are held in an inline arrangement by the left elongated bracket 3 and the right elongated bracket 4.

Figure 4:
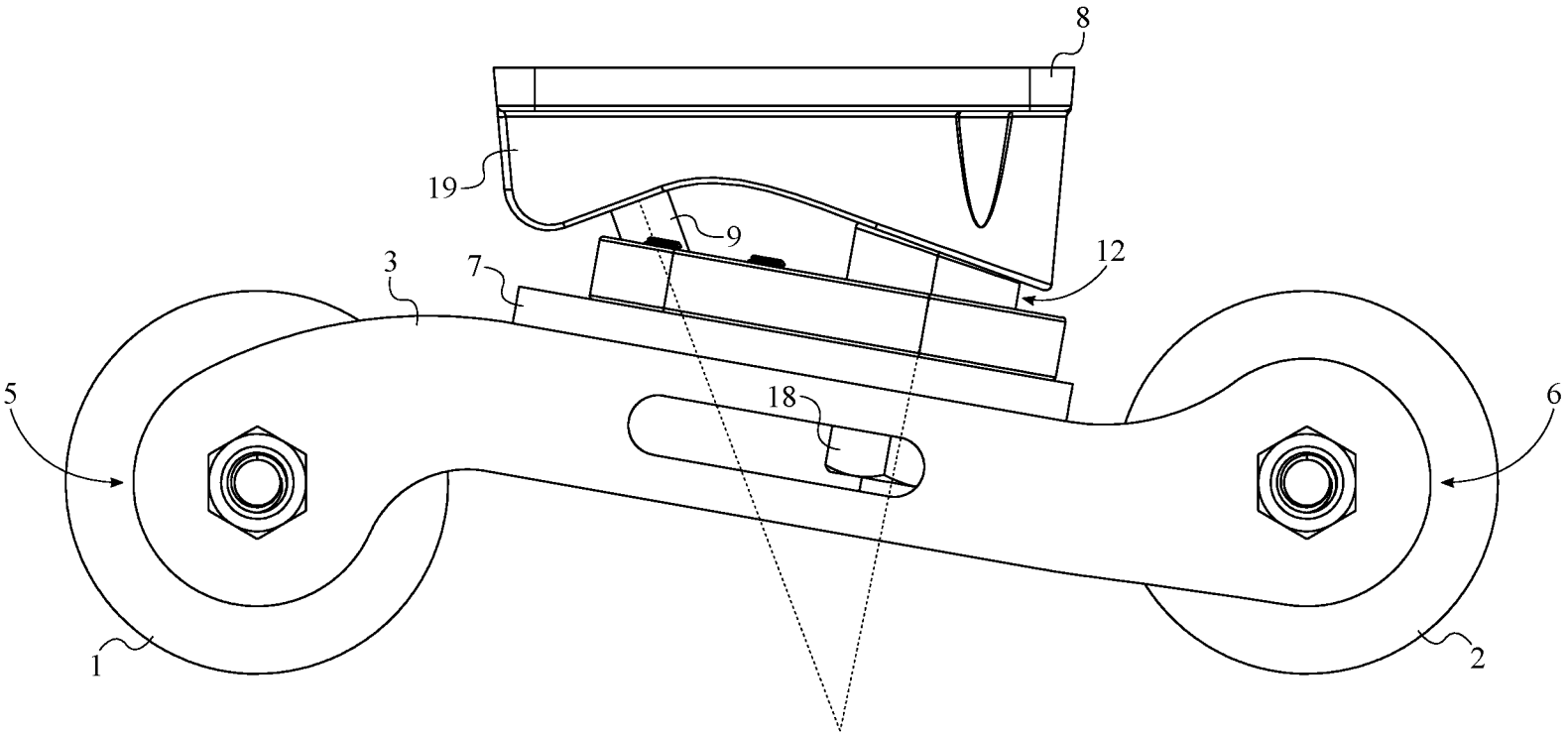
FIG. 4 is a left view of the present invention.
Figure 5:
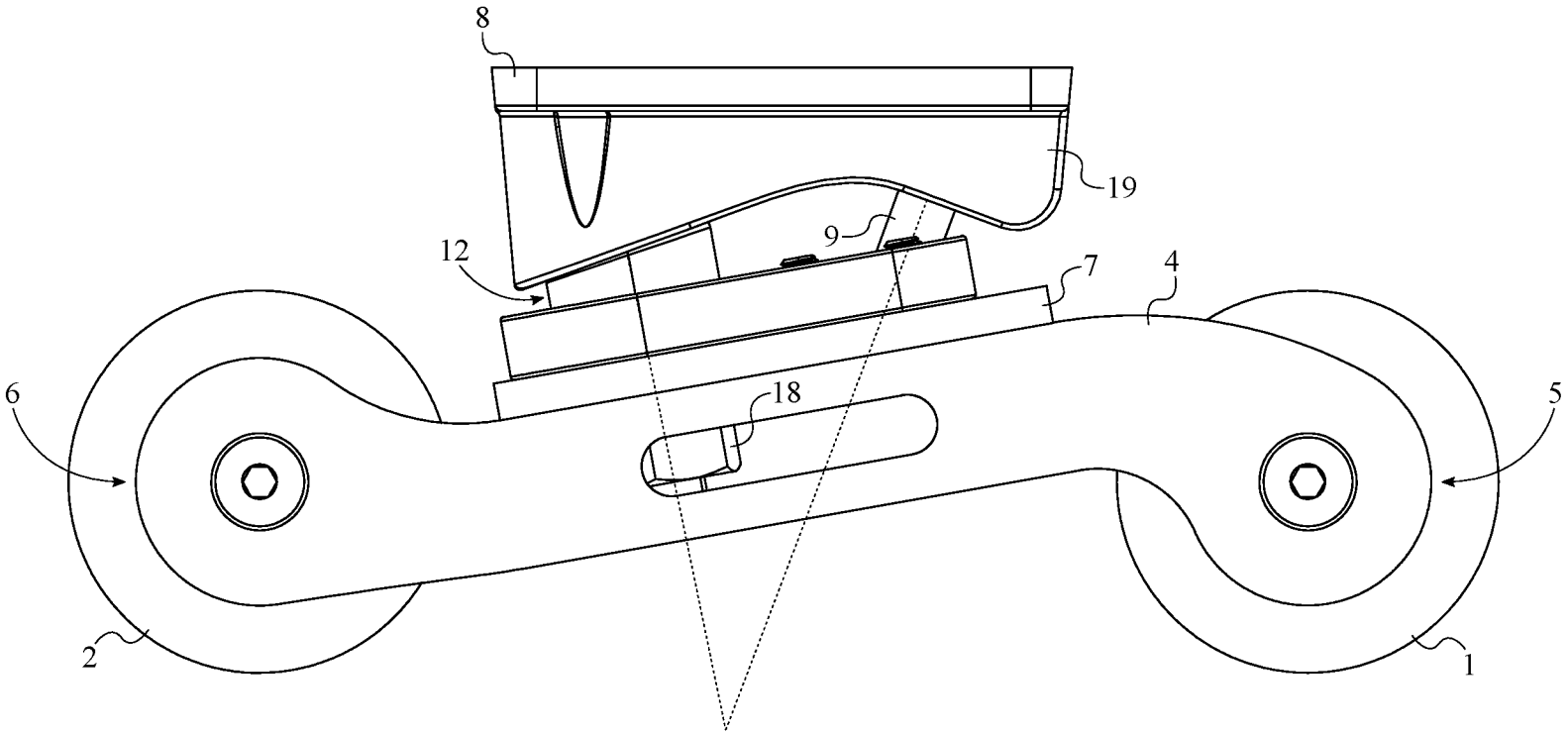
FIG. 5 is a right view of the present invention.
Figure 6:
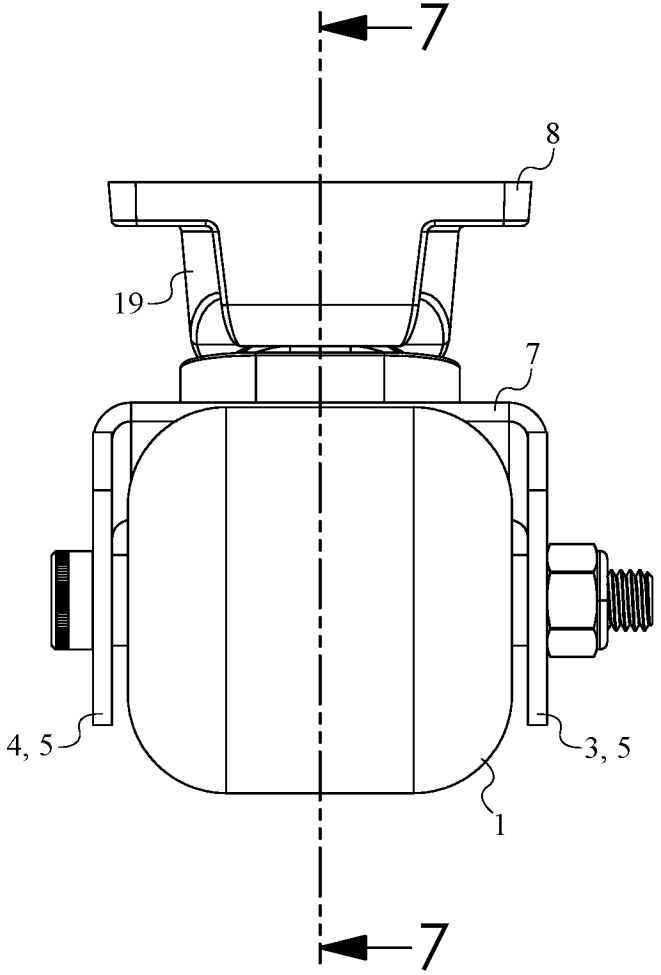
FIG. 6 is a front view of the present invention.

In order specifically define how the first support member 9 and the second support member 12 interact with each other while engaging the tilt steering feature of the present invention, the first support member 9 and the second support member 12 are arranged into a V-shaped configuration, which is shown in FIGS. 4 and 5. Moreover, a vertex of the V-shaped configuration is positioned adjacent to the cross platform 7 and is positioned offset from the base platform 8, which allows a tilting motion from the base platform 8 to be converted into a steering motion for the cross platform 7. The first support member 9 is also positioned in between the first wheel 1 and the second support member 12, and the second support member 12 being positioned in between the first support member 9 and the second wheel 2, which further defines the arrangement of the first support member 9 and the second support member 12 sandwiched between the base platform 8 and the cross platform 7.

As can be seen in FIG. 7, the present invention may further comprise a first axle 25 and a first bearing 23, which are used as a preferred means to rotatably connect the first wheel 1. The first axle 25 is stationarily mounted in between the first bracket end 5 of the left elongated bracket 3 and the first bracket end 5 of the right elongated bracket 4 so that the first axle 25 can act as a transfer point for the weight carried by the present invention into the first wheel 1 as the first wheel 1 is rolling. The first wheel 1 is rotatably mounted to the first axle 25 by the first bearing 23, which allows an inner race of the first bearing 23 to laterally slide about the first axle 25 and allows the outer race of the first bearing 23 to be torsionally connected to the first wheel 1.

As can be seen in FIG. 7, the present invention may further comprise a second axle 27 and a second bearing 28, which are used as a preferred means to rotatably connect the second wheel 2. The second axle 27 is stationarily mounted in between the second bracket end 6 of the left elongated bracket 3 and the second bracket end 6 of the right elongated bracket 4 so that the second axle 27 can act as a transfer point for the weight carried by the present invention into the second wheel 2 as the second wheel 2 is rolling. The second wheel 2 is rotatably mounted to the second axle 27 by the second bearing 28, which allows an inner race of the second bearing 28 to laterally slide about the second axle 27 and allows the outer race of the second bearing 28 to be torsionally connected to the second wheel 2.

Supplemental Description

The present invention consists of two wide inline wheels connected to a truck assembly. The present invention preferably comprises a plurality of flexible resin pivots, a kingpin, brackets, wheels, and a base. The truck assembly is connected to the base by a kingpin and a flexible resin pivot bushing. The truck assembly is held together by a kingpin. The kingpin uses two thick flexible resin bushings to clamp down on the truck assembly. The kingpin secures the truck assembly with a washer and nut. The two wheels are held in place by two parallel brackets that connect at their midpoint to the truck assembly. The brackets are held in place rigidly and do not pivot in any direction. The wheels are connected to the brackets at their end point farthest away from the truck assembly. The truck assembly is connected to a base plate via the kingpin and the rigid post.

The opposite side of the present invention contains a rigid post that is attached to the wheel assembly and is set at an angle and seated on a receptor that is attached to the board. This post assembly provides stability and allows for twisting motion as the kingpin turns left or right.

The turning mechanism of the present invention comes from the strategic positioning of the flexible resin points. They are concentrated around two locations, one under the forward connection to the base and the other at the two resin bushings that clamp down on the truck assembly. These pivot points are made of a flexible resin to allow for compression under pressure. When in use, one can apply pressure by tilting the base of the present invention left or right. The angle will determine the amount of turning force that is created. Once tilted, the truck assembly will turn left or right based on the angle of the tilt, creating a turning motion for the present invention. When the base is straightened to its original angle, the brackets and wheels return to neutral positions. The application of the present invention is targeted at sports use but could also use a new form of movement systems for industrial or commercial use.

The design of the present invention allows the in-line wheels to turn left or right sharply and cleanly by applying pressure to the left or right side of the assembly.

Although the invention has been explained in relation to its preferred embodiment, it is to be understood that many other possible modifications and variations can be made without departing from the spirit and scope of the invention as hereinafter claimed.

What is claimed is:

1. An inline wheeled truck comprising:
- a first wheel;
- a second wheel;
- a left elongated bracket;
- a right elongated bracket;
- a cross platform;
- a base platform;
- a first support member;
- a second support member;
- a cup bushing;
- the left elongated bracket and the right elongated bracket each comprising a first bracket end and a second bracket end;
- the first support member comprising a first proximal member end and a first distal member end;
- the left elongated bracket and the right elongated bracket being positioned parallel and offset from each other;
- the first wheel being rotatably mounted in between the first bracket end of the left elongated bracket and the first bracket end of the right elongated bracket;
- the second wheel being rotatably mounted in between the second bracket end of the left elongated bracket and the second bracket end of the right elongated bracket;
- the cross platform being connected in between the left elongated bracket and the right elongated bracket;
- the base platform being positioned offset from the cross platform;
- the first support member and the second support member being operatively mounted in between the cross platform and the base platform, wherein the first support member and the second support member are flexed to steer the first wheel and the second wheel;
- the first distal member end being pivotably mounted to the base platform by the cup bushing; and
- the first proximal member end being stationarily mounted to the cross platform.

2. The inline wheeled truck as claimed in claim 1 comprising:
- a proximal annular bushing;
- a distal annular bushing;
- a lock nut;
- the second support member being a kingpin;
- the second support member comprising a second proximal member end and a second distal member end;
- the second distal member end being stationarily mounted to the base platform;
- the second support member being serially positioned through the distal annular bushing, through the cross platform, and through the proximal annular bushing;
- the second proximal member end being threadibly engaged by the lock nut;
- the distal annular bushing being pressed against the cross platform; and
- the proximal annular bushing being pressed against the cross platform by the lock nut.

3. The inline wheeled truck as claimed in claim 2 comprising:
- a base extrusion;
- the base extrusion being positioned in between the base platform and the cross platform;
- the base extrusion being connected onto the base platform;
- the second support member being positioned through the base extrusion; and
- the distal annular bushing being pressed against the cross platform by the base extrusion.

4. The inline wheeled truck as claimed in claim 3 comprising:
- a distal washer;
- the second support member being positioned through the distal washer; and
- the distal washer being positioned in between the base extrusion and the distal annular bushing.

5. The inline wheeled truck as claimed in claim 2 comprising:
- a proximal washer;
- the second support member being positioned through the proximal washer; and
- the proximal washer being positioned in between the proximal annular bushing and the lock nut.

6. The inline wheeled truck as claimed in claim 1 comprising:
- the first support member and the second support member being positioned coincident to a sagittal plane;
- a first rotation axis of the first wheel and a second rotation axis of the second wheel being positioned normal to the sagittal plane; and
- the left elongated bracket and the right elongated bracket being positioned parallel to the sagittal plane.

7. The inline wheeled truck as claimed in claim 1 comprising:

the first support member and the second support member being arranged into a V-shaped configuration;

a vertex of the V-shaped configuration being positioned adjacent to the cross platform;

the vertex of the V-shaped configuration being positioned offset from the base platform;

the first support member being positioned in between the first wheel and the second support member; and the second support member being positioned in between the first support member and the second wheel.

8. The inline wheeled truck as claimed in claim 1 comprising:

a first axle;

a first bearing;

the first axle being stationarily mounted in between the first bracket end of the left elongated bracket and the first bracket end of the right elongated bracket; and the first wheel being rotatably mounted to the first axle by the first bearing.

9. The inline wheeled truck as claimed in claim 1 comprising:

a second axle;

a second bearing;

the second axle being stationarily mounted in between the second bracket end of the left elongated bracket and the second bracket end of the right elongated bracket; and the second wheel being rotatably mounted to the second axle by the second bearing.

10. An inline wheeled truck comprising:

a first wheel;

a second wheel;

a left elongated bracket;

a right elongated bracket;

a cross platform;

a base platform;

a first support member;

a second support member;

a proximal annular bushing;

a distal annular bushing;

a lock nut;

the left elongated bracket and the right elongated bracket each comprising a first bracket end and a second bracket end;

the second support member comprising a second proximal member end and a second distal member end;

the left elongated bracket and the right elongated bracket being positioned parallel and offset from each other;

the first wheel being rotatably mounted in between the first bracket end of the left elongated bracket and the first bracket end of the right elongated bracket;

the second wheel being rotatably mounted in between the second bracket end of the left elongated bracket and the second bracket end of the right elongated bracket;

the cross platform being connected in between the left elongated bracket and the right elongated bracket;

the base platform being positioned offset from the cross platform;

the first support member and the second support member being operatively mounted in between the cross platform and the base platform, wherein the first support member and the second support member are flexed to steer the first wheel and the second wheel;

the second support member being a kingpin;

the second distal member end being stationarily mounted to the base platform;

the second support member being serially positioned through the distal annular bushing, through the cross platform, and through the proximal annular bushing;

the second proximal member end being threadibly engaged by the lock nut;

the distal annular bushing being pressed against the cross platform; and the proximal annular bushing being pressed against the cross platform by the lock nut.

11. The inline wheeled truck as claimed in claim 10 comprising:

a cup bushing;

the first support member comprising a first proximal member end and a first distal member end;

the first distal member end being pivotably mounted to the base platform by the cup bushing; and the first proximal member end being stationarily mounted to the cross platform.

12. The inline wheeled truck as claimed in claim 10 comprising:

a base extrusion;

the base extrusion being positioned in between the base platform and the cross platform;

the base extrusion being connected onto the base platform;

the second support member being positioned through the base extrusion; and the distal annular bushing being pressed against the cross platform by the base extrusion.

13. The inline wheeled truck as claimed in claim 10 comprising:

a distal washer;

the second support member being positioned through the distal washer; and the distal washer being positioned in between the base extrusion and the distal annular bushing.

14. The inline wheeled truck as claimed in claim 10 comprising:

a proximal washer;

the second support member being positioned through the proximal washer; and the proximal washer being positioned in between the proximal annular bushing and the lock nut.

15. The inline wheeled truck as claimed in claim 10 comprising:

the first support member and the second support member being positioned coincident to a sagittal plane;

a first rotation axis of the first wheel and a second rotation axis of the second wheel being positioned normal to the sagittal plane; and the left elongated bracket and the right elongated bracket being positioned parallel to the sagittal plane.

16. The inline wheeled truck as claimed in claim 10 comprising:

the first support member and the second support member being arranged into a V-shaped configuration;

a vertex of the V-shaped configuration being positioned adjacent to the cross platform;

the vertex of the V-shaped configuration being positioned offset from the base platform;

the first support member being positioned in between the first wheel and the second support member; and the second support member being positioned in between the first support member and the second wheel.

17. The inline wheeled truck as claimed in claim 10 comprising:

a first axle;

a first bearing;

the first axle being stationarily mounted in between the first bracket end of the left elongated bracket and the first bracket end of the right elongated bracket; and the first wheel being rotatably mounted to the first axle by the first bearing.

18. The inline wheeled truck as claimed in claim 10 comprising:

a second axle;

a second bearing;

the second axle being stationarily mounted in between the second bracket end of the left elongated bracket and the second bracket end of the right elongated bracket; and the second wheel being rotatably mounted to the second axle by the second bearing.

* * * * *